US009121236B2

(12) United States Patent
Matlewski et al.

(10) Patent No.: US 9,121,236 B2
(45) Date of Patent: Sep. 1, 2015

(54) STORAGE, HANDLING AND POSITIONING DEVICE FOR DRILL RODS AND METHODS THEREOF

(71) Applicant: Longyear TM, Inc., South Jordan, UT (US)

(72) Inventors: Tomasz Matlewski, Katy Wroclawskie (PL); Dan Garland, Park City, UT (US)

(73) Assignee: Longyear TM, Inc., South Jordan, UT (US)

( * ) Notice: Subject to any disclaimer, the term of this patent is extended or adjusted under 35 U.S.C. 154(b) by 322 days.

(21) Appl. No.: 13/730,194

(22) Filed: Dec. 28, 2012

(65) Prior Publication Data

US 2014/0182936 A1 Jul. 3, 2014

(51) Int. Cl.
*E21B 19/08* (2006.01)
*E21B 19/14* (2006.01)
*E21B 19/083* (2006.01)

(52) U.S. Cl.
CPC ..... *E21B 19/14* (2013.01); *E21B 19/08* (2013.01); *E21B 19/083* (2013.01)

(58) Field of Classification Search
CPC ..... E21B 19/08; E21B 19/083; E21B 19/14; E21B 19/15; E21B 19/155
USPC ..... 175/52
See application file for complete search history.

(56) References Cited

U.S. PATENT DOCUMENTS 3,058,533 A * 10/1962 Collins, Jr. ..... 175/85
3,913,754 A * 10/1975 Swartz et al. ..... 414/22.66
3,965,994 A 6/1976 Hilding
6,189,628 B1 * 2/2001 Jenne ..... 175/52
7,600,584 B2 10/2009 Sewell et al.
2001/0045301 A1 * 11/2001 Bayer et al. ..... 175/52
2002/0153169 A1 10/2002 Sewell
2003/0196791 A1 * 10/2003 Dunn et al. ..... 166/77.51
2007/0119623 A1 * 5/2007 Sewell et al. ..... 175/52
2011/0188973 A1 8/2011 Baumler
2012/0118639 A1 5/2012 Gerber

OTHER PUBLICATIONS

International Search Report and Written Opinion of International Search Authority for Application No. PCT/US2010/072074 (mailed Sep. 2, 2013).

* cited by examiner

*Primary Examiner* — Brad Harcourt
(74) *Attorney, Agent, or Firm* — Ballard Spahr LLP

(57) ABSTRACT

Implementations described herein comprise systems, apparatus and methods for drill string component storage, handling and positioning devices. The handling device can comprise a magazine assembly configured for storing and handling elongate members having a magazine assembly and at least one conveyor roller chain operatively associated with the magazine assembly. The magazine assembly can further comprise an internal path having a loading aperture and a dispensing aperture disposed on opposing ends of the internal path. The at least one conveyor roller chain can be configured to controllably urge the at least one drill string component from the loading aperture to the dispensing aperture. The handling device can further comprise an armature assembly operatively associated with the magazine assembly. The armature assembly can be configured to selectively grasp one of the at least one drill string components located at the dispensing aperture and subsequently move the drill string component to a desired position.

21 Claims, 12 Drawing Sheets

STORAGE, HANDLING AND POSITIONING DEVICE FOR DRILL RODS AND METHODS THEREOF

BACKGROUND OF THE INVENTION

1. The Field of the Invention

Implementations described herein relate generally to drill string component storage, handling and positioning devices and associated methods. In particular, implementations described herein relate to drill string component storage and handling devices operatively associated with an armature assembly configured to position the drill string component relative to a drill head.

2. Background

Oilfield, exploration, and other drilling technologies make extensive use of drill string components such as, for example and without limitation, rods, pipes, tubes, casings and the like. These drill string components can be used, for example, in the installation and maintenance of bore holes or wells in the ground. Drill rigs may be employed to create such holes and/or wells using drill string components. Such drill rigs generally comprise an upstanding mast which has a drill head mounted to it where the drill head can be capable of movement along the mast and the drill head can have means which can receive and engage the upper end of a drill string component and can apply a rotational force to the drill string component to cause it to rotate within the bore hole. Such rotation can result in a cutting action when a drill bit is mounted to the lower end of the elongate member.

A plurality of drill string components can comprise a drill string when a number of lengths of drill string components are connected end to end. In many cases, each length of drill string component can be generally at the most equal to the height of the drill rig mast. It can be usual that each length of each drill string component can be up to about six meters. During a drilling operation when the drill head has reached the lower end of the mast, the drill string component can be clampingly retained and the drill head can be disconnected from the drill string component. A fresh length of drill string component may then be raised into position in order that the upper end of the fresh length can be engaged to the drill head and the lower end of the fresh length can be engaged with the upper end of the drill string. Once the fresh length of drill string component has been installed, the drilling operation can recommence until the drill head again reaches the lower end of the mast. During drilling activities of deep bore holes which may extend for hundreds of meters, it can be necessary to locate fresh lengths of drill string component into a drill string at very regular intervals.

As one skilled in the art will appreciate, the drill rig may be mounted to the chassis of a motorized vehicle such as a truck or lorry and the lengths of drill rod can be mounted in a stationary storage zone such that they lie horizontally in a stacked array beside the drilling mast on the same vehicle or, alternatively, on a vehicle parked alongside the drilling rig or on the ground beside the drilling rig.

The usual method for raising a fresh length of drill string component from the bin to the mast comprises mounting a holder along the length of the length of drill string component connecting that holder to a cable carried by a winch located at the upper end of the mast and then lifting the length of drill rod into position. This may require manipulation by a member of the drill rig crew who can be needed to support and guide the lowermost end of the length of drill string component as the length of drill string component is being raised into position. Due to at least the nature of drilling sites, this action can be quite hazardous. In addition, during the raising of the drill string component, it may be possible for the upper portion of the length of drill string component to strike some obstruction on the drill mast which can cause the lower end to move in an unpredictable manner which can result in injury to the crew member. In addition, this process can require joint coordination between the crew member guiding the one end and the other crew member controlling the winch.

Similarly during the raising of a drill string, it can be necessary to regularly remove lengths of drill string component from a drill string and locate those lengths in the storage zone located beside the mast which may be either located on the same vehicle as the drilling rig or on some adjacent vehicle or on the ground beside the drilling rig. This can also create hazards for the personnel required to handle and store the lengths of drill string components.

Accordingly, a need exists for improved storage, handling and positioning devices for drill string components that provide for increased efficiency and safety as well as integrate drill string component storage, handling and positioning functions.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

One or more implementations described herein overcome one or more of the foregoing or other problems in the art with storage, handling and positioning of elongate members commonly used in oilfield, drilling and exploration industries such as, for example and without limitation, drill string components. Accordingly, it is an object of this disclosure to provide a means of storage, handling and positioning of elongate members such as lengths of drill string components that enables increased efficiency and safety as well as integrates the storage, handling and positioning functions.

In one aspect, implementations of the present disclosure comprise a magazine assembly configured to store, handle and position drill string components. In some aspects, the magazine assembly further comprises at least one conveyor roller chain and an armature assembly.

In various aspects, implementations of the present disclosure provide for a magazine assembly that can have an interior path having a loading aperture at one end and a dispensing aperture at another end. In further aspects, the interior path can be S-shaped.

In further aspects, implementations of the present invention comprise at least one conveyor roller chain operatively positioned at least partially within the interior path of the magazine assembly. In further aspects, the at least one conveyor roller chain can be driven by at least one drive chain. In even further aspects, the at least one conveyor roller chain comprises a plurality of conveyor roller chains. In yet further aspects, the plurality of conveyor roller chains can be synchronized. In even further aspects, the at least one conveyor roller chain has at least one seat positioned thereon.

In other aspects, the armature assembly can be operatively associated with the magazine assembly and configured to selectively grasp at least one drill string component disposed at the dispensing end of the magazine assembly. In further aspects, the armature assembly can be operable to subsequently position the drill string component relative to a drill head.

In one or more other aspects, the magazine assembly can be configured to be rotated selectively from a substantially horizontal position to a substantially vertical position. In optional aspects, the magazine assemble can be configured to be moved selectively along or about the longitudinal axis of the magazine assembly.

In addition to the foregoing, an implementation of a method of storing, handling and positioning drill string components can be provided. The method can involve inserting at least one drill string component into the loading aperture, urging the at least one drill string component about the internal path of the magazine assembly to the dispensing aperture, selectively grasping the at least one drill string component with the armature assembly and selectively positioning the drill string component coaxially with the drill head.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate aspects and together with the description, serve to explain the principles of the methods and systems.

DETAILED DESCRIPTION OF THE PREFERRED ASPECTS

Figure 1:
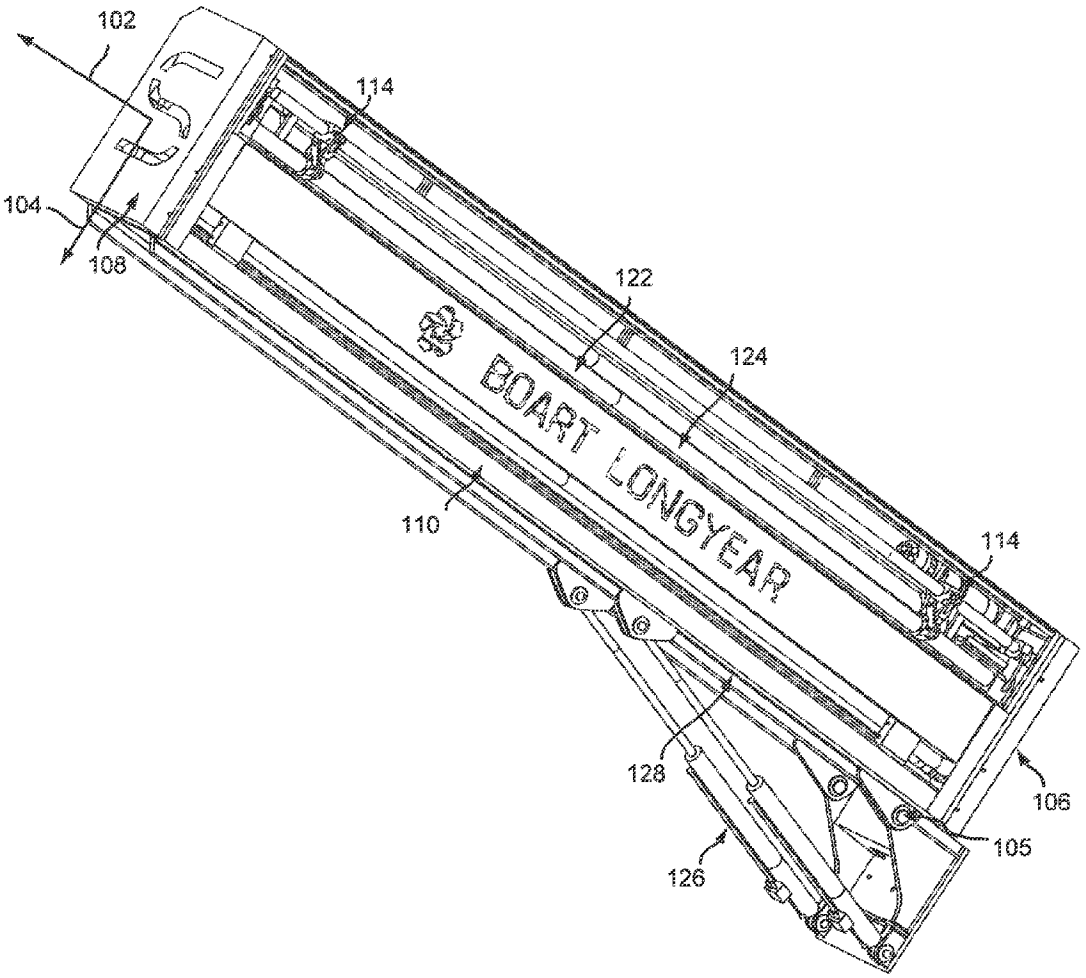
FIG. 1 illustrates a perspective view of one illustrative example of a magazine assembly of the present disclosure.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. To this end, those skilled in the relevant art will recognize and appreciate that many changes can be made to the various aspects of the invention described herein, while still obtaining the beneficial results described herein. It will also be apparent that some of the desired benefits described herein can be obtained by selecting some of the features described herein without utilizing other features. Accordingly, those who work in the art will recognize that many modifications and adaptations to the present invention are possible and can even be desirable in certain circumstances and are a part described herein. Thus, the following description is provided as illustrative of the principles described herein and not in limitation thereof.

Reference will be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects drill string component storage, handling and positioning have not been described in particular detail in order to avoid unnecessarily obscuring aspects of the disclosed implementations.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal aspect. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be predefined it is understood that each of these additional steps can be predefined with any specific aspect or combination of aspects of the disclosed methods.

Implementations described herein are directed toward, devices, systems and methods that provide for safe and efficient storage, handling and positioning of tubular members such as, for example and without limitation, those used in oilfield, exploration and other drilling technologies. For example, one or more implementations described herein comprise effective storage, handling and positioning devices for drill string components. In certain aspects, implementations of the present disclosure can improve safety and efficiency over conventional storage, handling and positioning devices. In particular, one or more implementations comprise a magazine assembly configured for storing, moving and positioning drill string components comprising a magazine assembly, at least one roller conveyor belt operatively associated with the magazine assembly, and an armature assembly.

In one or more aspects, the magazine assembly comprises an interior path having a loading aperture at a loading end and a dispensing aperture at a dispensing end. In one or more other aspects, the at least one roller conveyor belt can have at least one seat configured to seat one drill string component such that the roller conveyor belt can urge the drill string component along the internal path to the dispensing end. In even further aspects, the at least one conveyor roller chain can be driven by at least one drive chain operatively associated with the conveyor roller chain disposed within one of the first end and the second end. In other aspects, the armature assembly operatively associated with the magazine assembly can then selectively grasp one drill string component and subsequently selectively move the drill string component to a position that can be substantially co-axial with a drill head. Such storage, handling and positioning devices can substantially increase the safety and productivity while lowering cost over conventional handling devices and techniques where a stationary drill string component bin can be placed near a drill rig and operators use handling devices to transport each drill string component of a drill string to the drill head.

Reference will now be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects of in-field equipment for handling, coupling and recovering tubular members such as, for example and without limitation, drill string components and the like have not been described in particular detail in order to avoid unnecessarily obscuring aspects of the disclosed implementations.

Turning now to FIGS. 1-11, an implementation of one exemplary aspect of a drill string component storage, handling, and positioning system for drill string components is illustrated. The handling device 100 can have a longitudinal axis 102, a transverse axis 104, a rotation axis 105, a first end 106, and a second end 108. The handling device 100 can further comprise a magazine assembly 110, at least one conveyor roller chain 112, and an armature assembly 114. In one aspect, the magazine assembly can comprise an interior path 116 having a loading aperture 118 at a loading end 120 and a dispensing aperture 122 at a dispensing end 124. In a further aspect, the interior path of the magazine assembly 110 can be S-shaped. In other aspects, the at least one conveyor roller chain 112 can be disposed within and operatively associated with the magazine assembly and, in additional aspects, the at least one conveyor roller chain can have at least one seat 130 disposed thereon. In even further aspects, the at least one conveyor roller chain can be driven by at least one drive chain operatively associated with the conveyor roller chain disposed within one of the first end and the second end. The armature assembly 114 can be operatively associated with the magazine assembly and configured to selectively grasp a drill string component positioned at or near the dispensing aperture and, subsequently, move the drill string component into a position that can be substantially co-axial with a drill string head. In operation, at least one drill string component can be orientated parallel to the longitudinal axis of the magazine assembly and inserted into the loading aperture. The at least one seat on the at least one conveyor roller chain controllably urges the at least one drill string component across the interior path to the dispensing aperture. The armature assembly can then actuate to selectively grasp the at least one drill string component and move the drill string component to a desired position.

In various aspects, the handling device 100 can be selectively rotated by a rotating means 126 along its rotation axis 105 about the first end 106 from about 0° (horizontal) to about 90° (vertical) in order to at least partially co-axially align the drill string component with the drill head. In some aspects, the rotating means can be, for example and without limitation, a hydraulic lift, a rotational motor, and the like. In further aspects, the rotating means can be operatively associated with at least the magazine assembly of the handling device. In operation, the magazine can be used at any angle between a horizontal and a vertical position.

In various other aspects, the handling device 100 can be selectively moved by a translation means 128 along and about its longitudinal axis 102 in order to at least partially co-axially align the drill relative to the drill head. In some aspects, the translation means can be configured to move along at least one of the longitudinal axis and the transverse axis of the magazine assembly and can be enabled by use of, for example and without limitation, a single or dual axis motorized linear stage, a rack and pinion linear actuator, a chain gear, a wench, a hydraulic circuit, and the like. In some aspects, the translation means can be operatively associated with at least the magazine assembly and, in additional or alternative aspects, can be integral with the rotating means. In other aspects, the translation means can be configured to move any distance along and about its longitudinal axis to accommodate any requirements for any particular application. In other aspects, the translation means can be configured to move about 3 meters and, more preferably, about 1 meter long its longitudinal axis.

Figure 2:
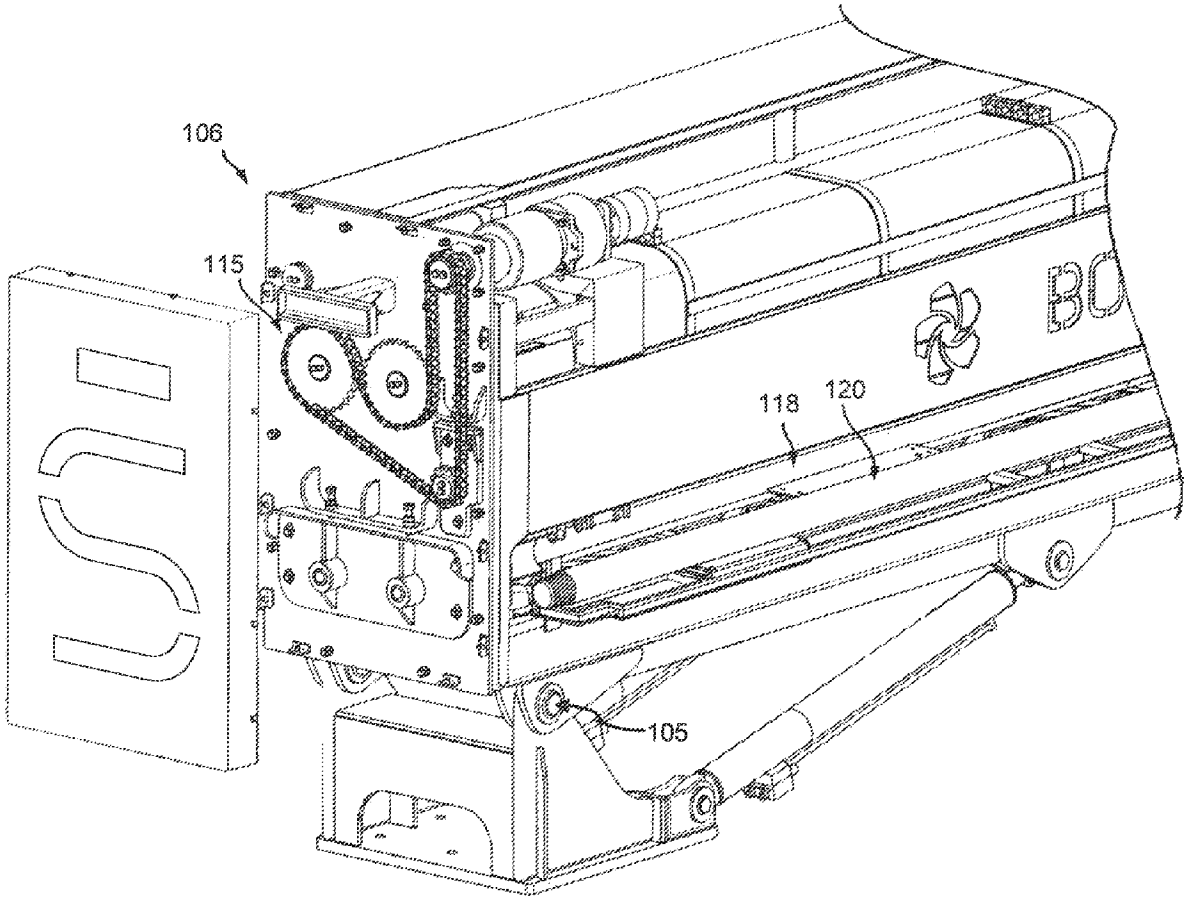
FIG. 2 illustrates an exploded view of a first end of a magazine assembly.
Figure 3:
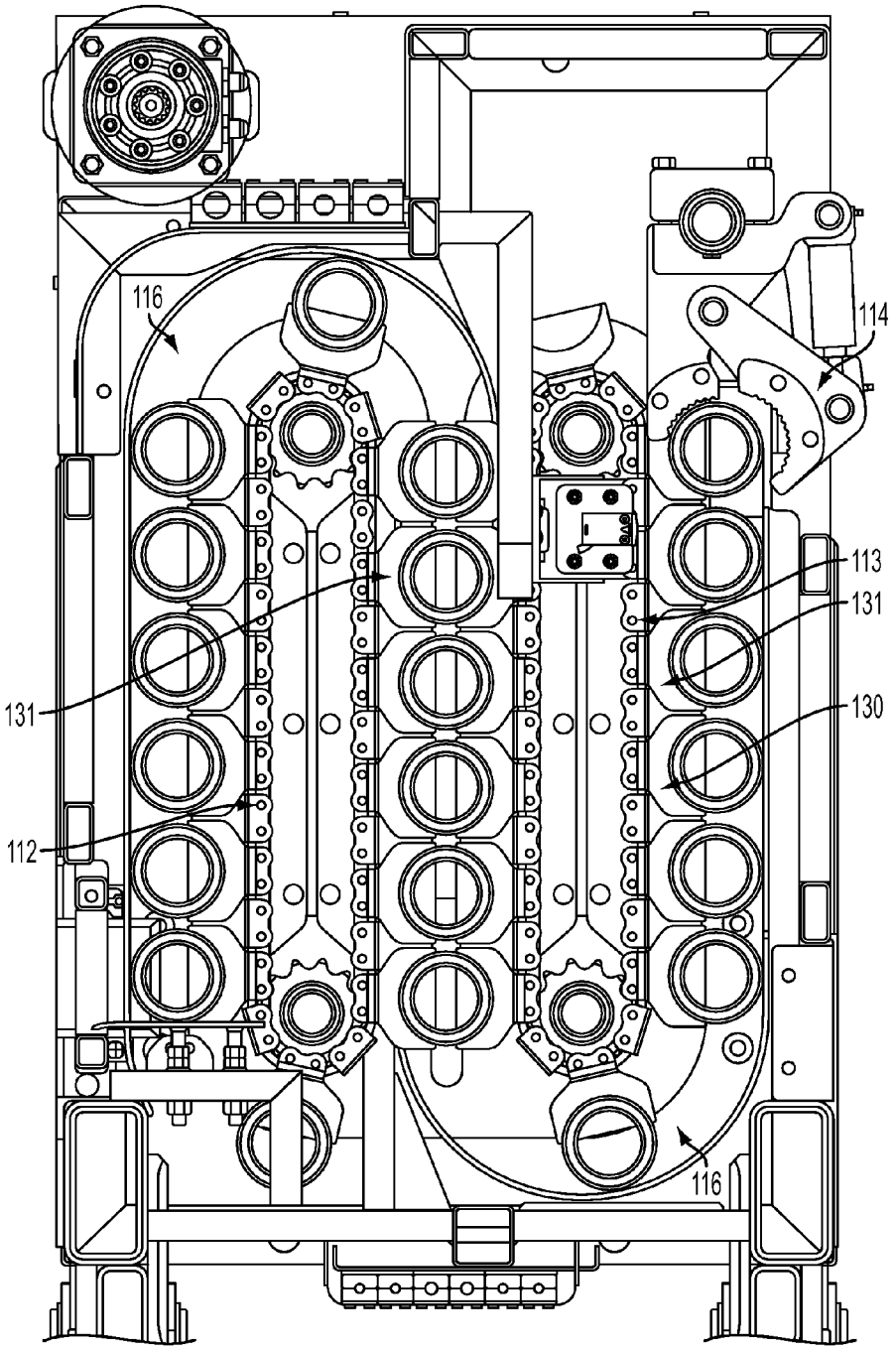
FIG. 3 illustrates a lateral cross-sectional view of an intermediate portion of the magazine assembly.
Figure 4:
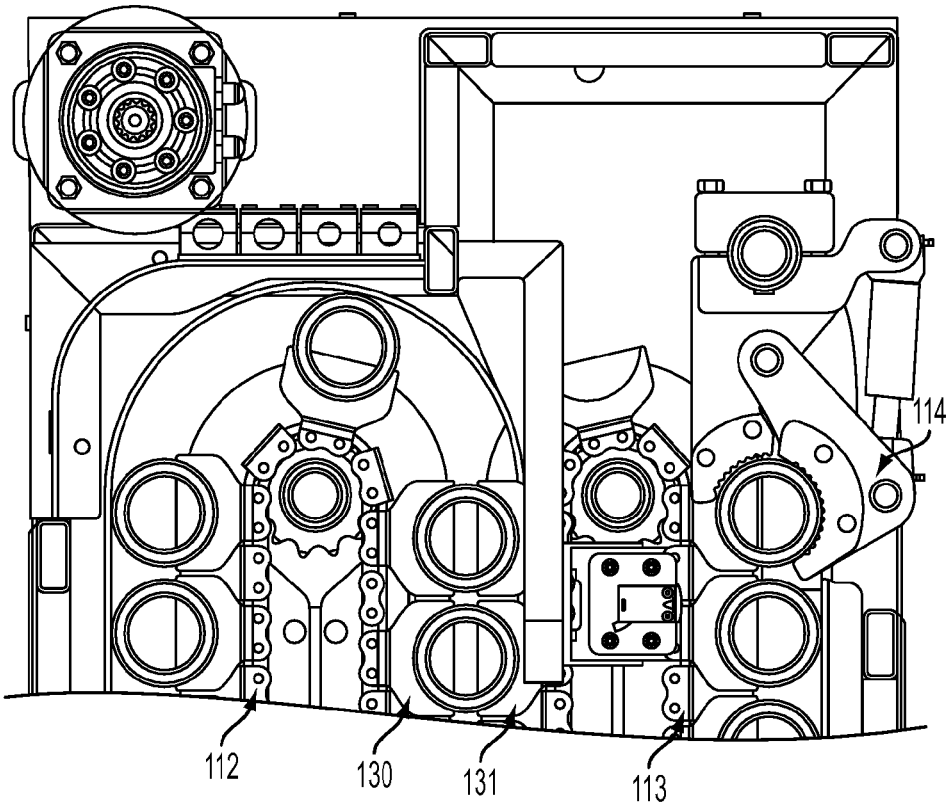
FIG. 4 illustrates a second lateral cross-sectional view of an intermediate portion of the magazine assembly showing the armature assembly rotationally positioned within the magazine assembly.
Figure 5:
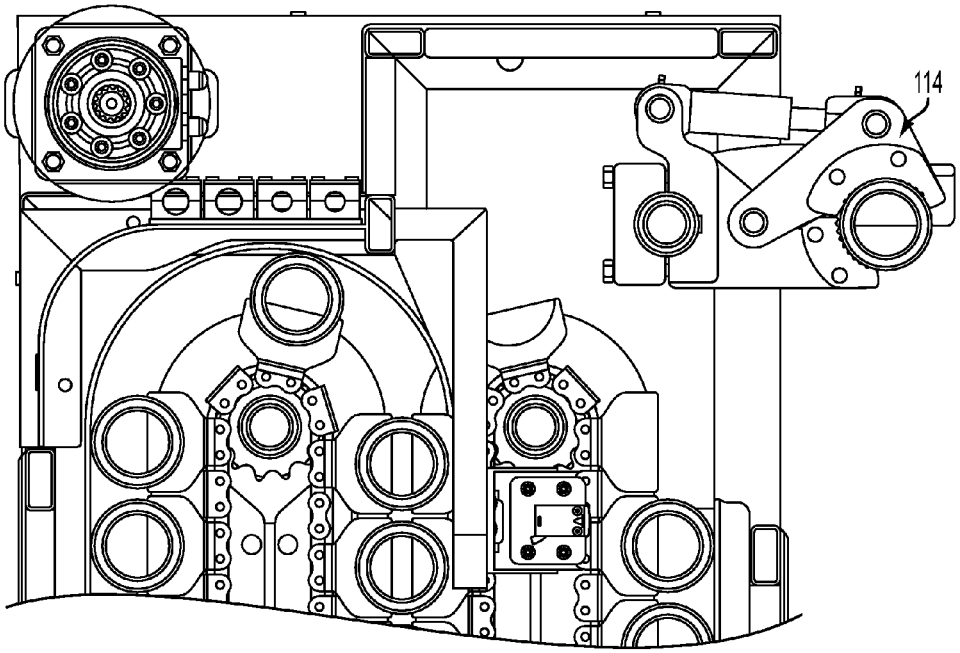
FIG. 5 illustrates a third lateral cross-sectional view of an intermediate portion of the magazine assembly showing the armature assembly rotationally positioned outside the magazine assembly.
Figure 6:
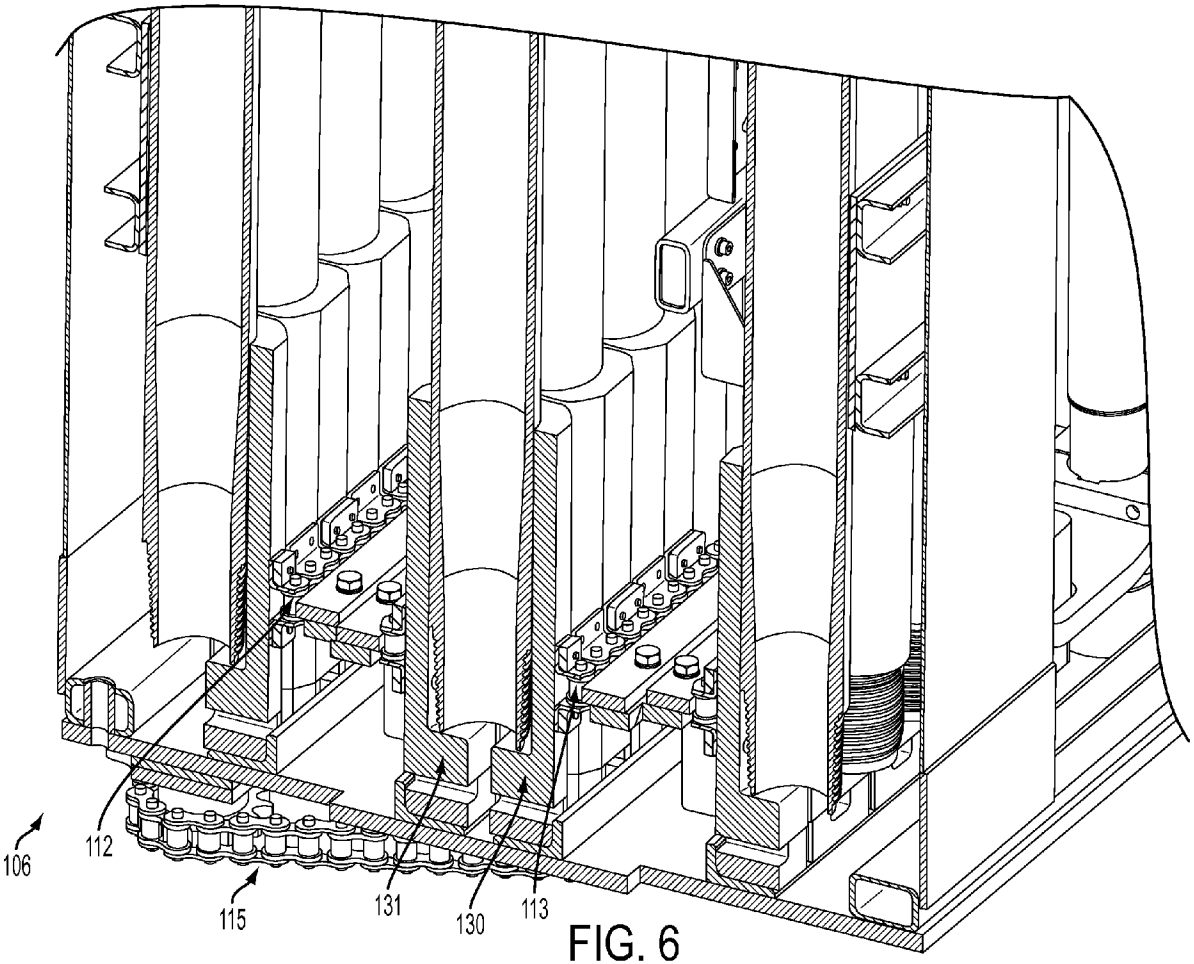
FIG. 6 illustrates a lateral cross-sectional view of a first end of a magazine assembly.
Figure 7:
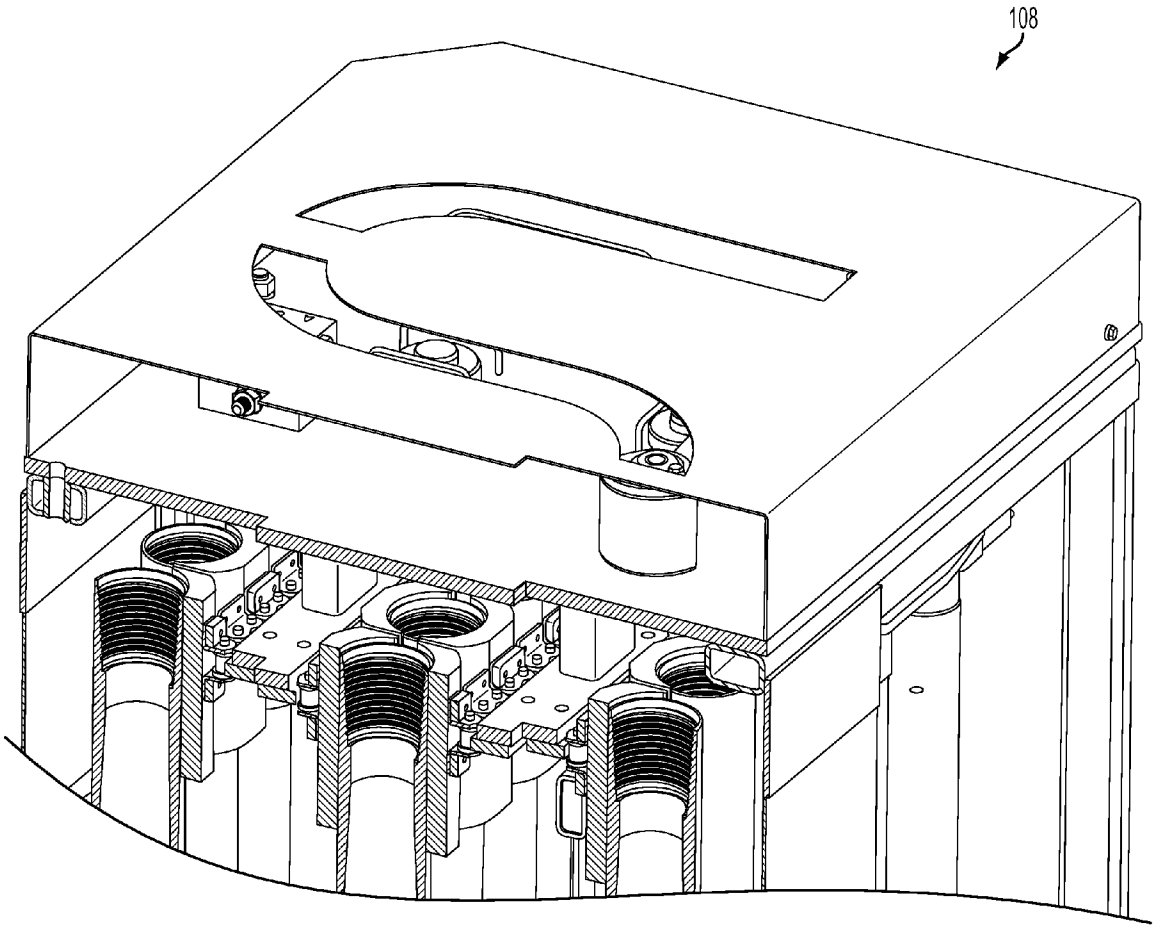
FIG. 7 illustrates a lateral cross-sectional view of a second end of a magazine assembly.

In a further aspect and as shown in at least FIG. 2, it can be contemplated that additional drill string components can be feed into the handling device 100 during operation via a loading aperture 118 defined at a loading end 120 of the handling device 100.

In other aspects shown in FIGS. 3-6, the drill string component handling device 100 uses at least a pair of conveyor roller chains 112, 113 equipped with a plurality of seats 130, 131 that can be configured to controllably urge the individual drill string components about an interior path 116 in the magazine assembly from a loading end 120 to a dispensing end 124. In further aspects, the drill string component handling device can use at least two pairs of conveyor roller chains 112, 113. In even further aspects, the interior path 116 can be S-shaped. In aspects, the pair of conveyor roller chains 112, 113 can be driven by a single drive chain 115 positioned at a first end 106 of the magazine to ensure synchronous movement of the conveyor roller chains. In other aspects, the second end 108 can comprise fixed bearings configured to follow the movement produced by the drive chain. In yet other aspects, the plurality of seats 130, 131 can be arranged such that a pair of opposing seats can grasp one drill string component and move in synchronicity to controllably urge the component along at least a portion of the interior path 116. At the dispensing end, an armature assembly can be configured to selectively grasp the drill string component and to subsequently rotatively move the drill string component into the desired position relative to the drill head.

Figure 8:
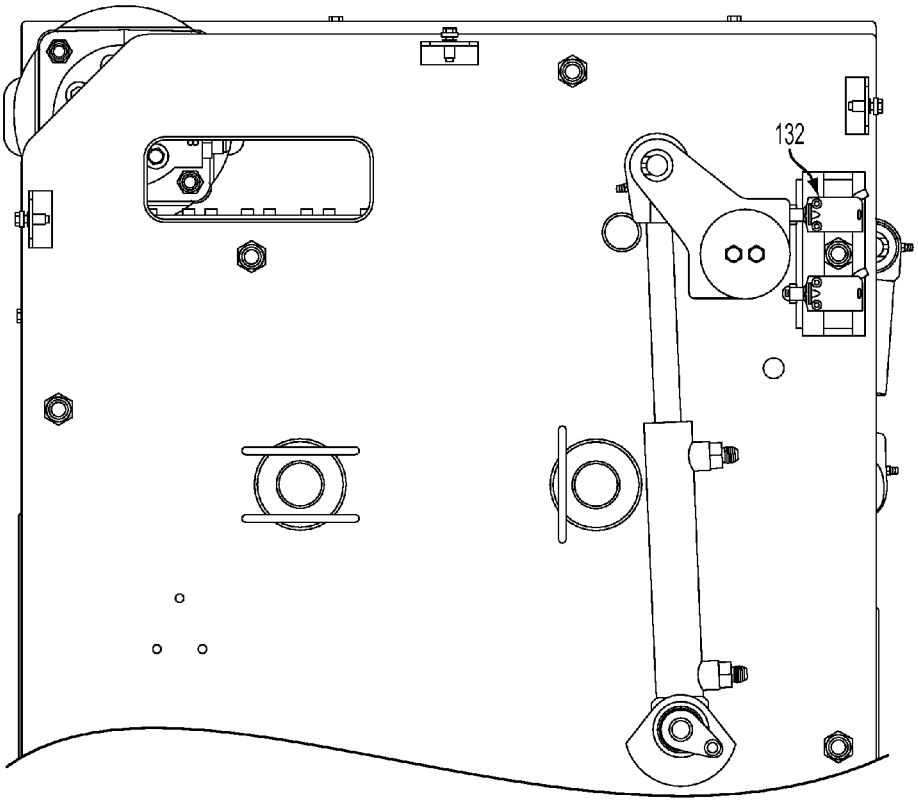
FIG. 8 illustrates an exemplary location of a first sensor configured to indicate whether or not the armature is rotationally positioned within the magazine assembly.
Figure 9:
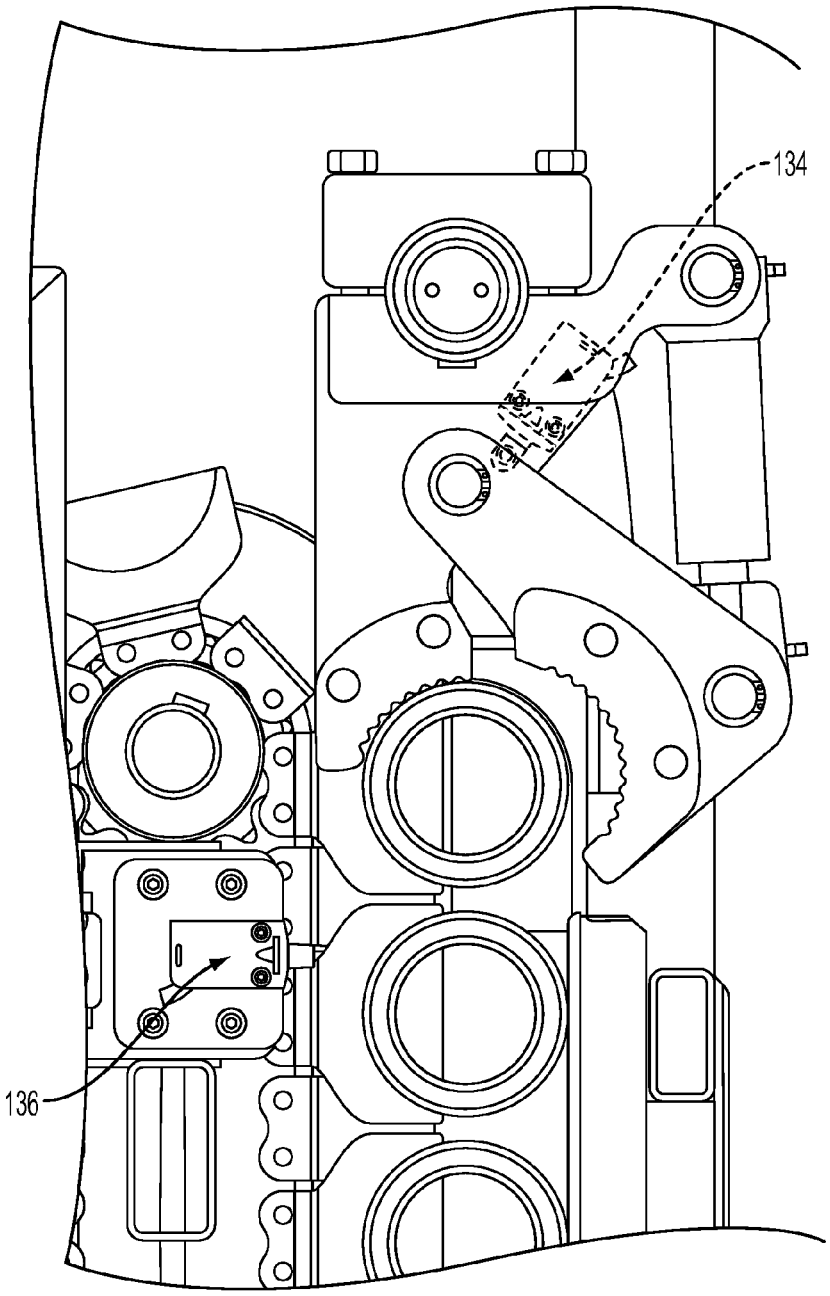
FIG. 9 illustrates exemplary locations of a fifth and a sixth sensor, the sixth sensor being operative to indicate whether the armature can receive a drill string component and the fifth sensor tracking the indexing of the conveyor roller chain.
Figure 10:
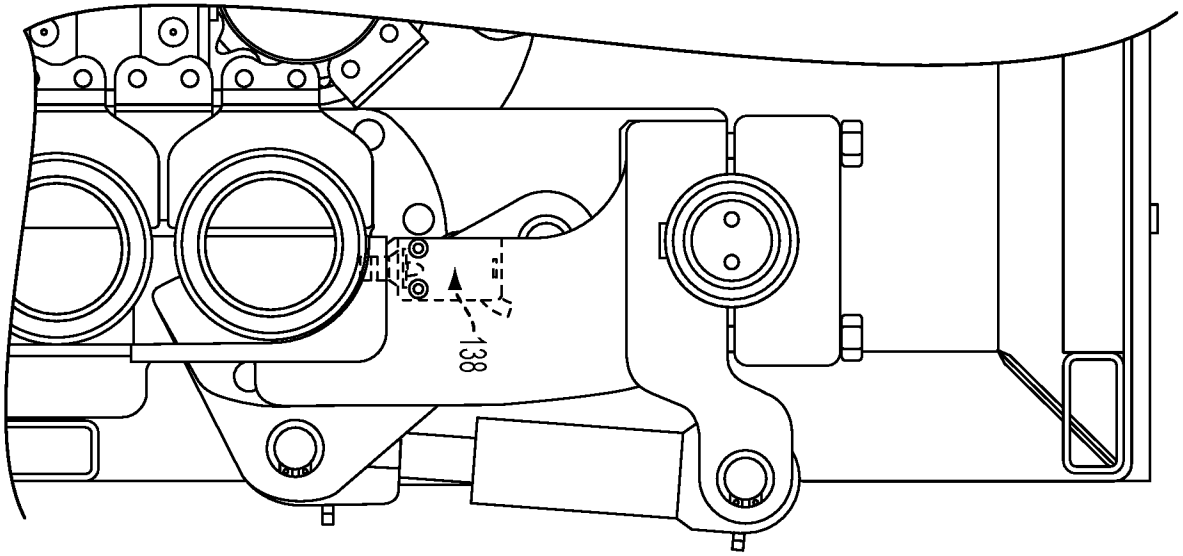
FIG. 10 illustrates an exemplary location of third sensor operative to indicate the presence of a drill string component in the armature assembly.
Figure 11:
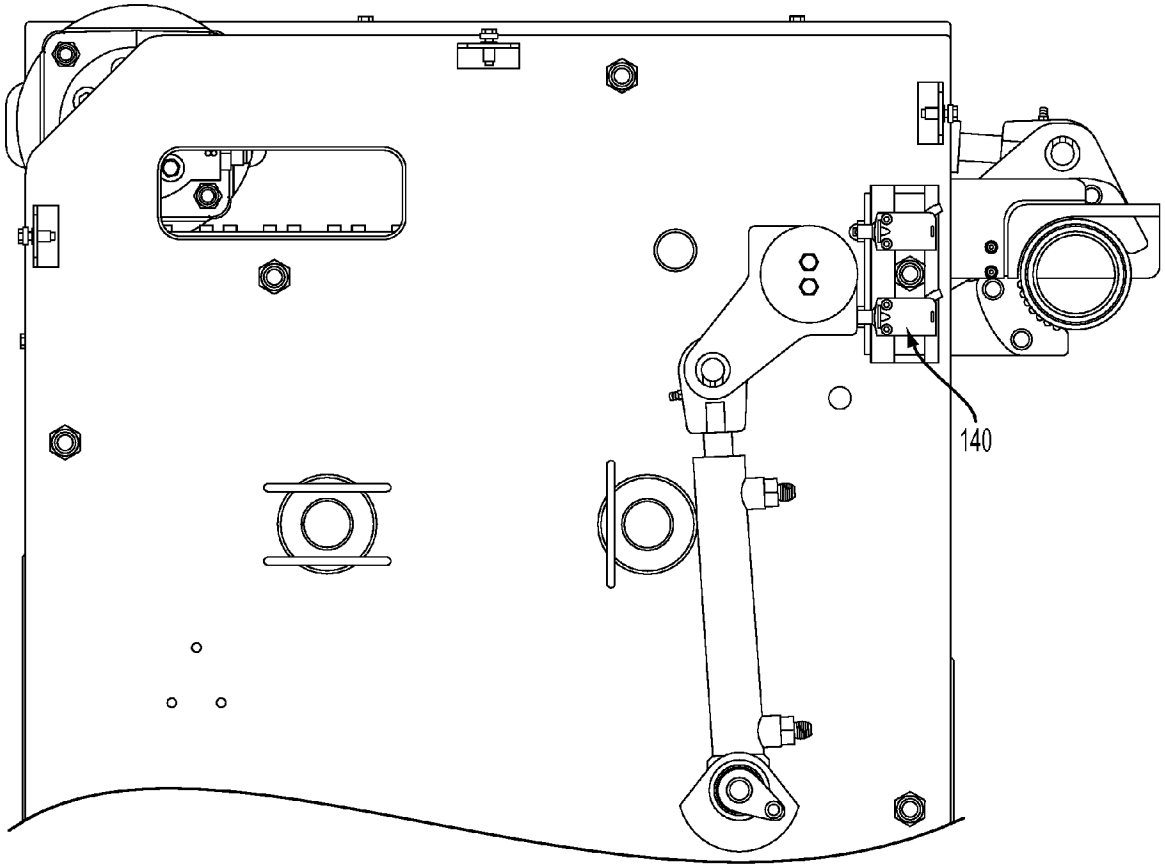
FIG. 11 illustrates an exemplary location of a second sensor configured to indicate when a drill string component within the armature assembly is ready to be transferred to a drill head.
Figure 12:
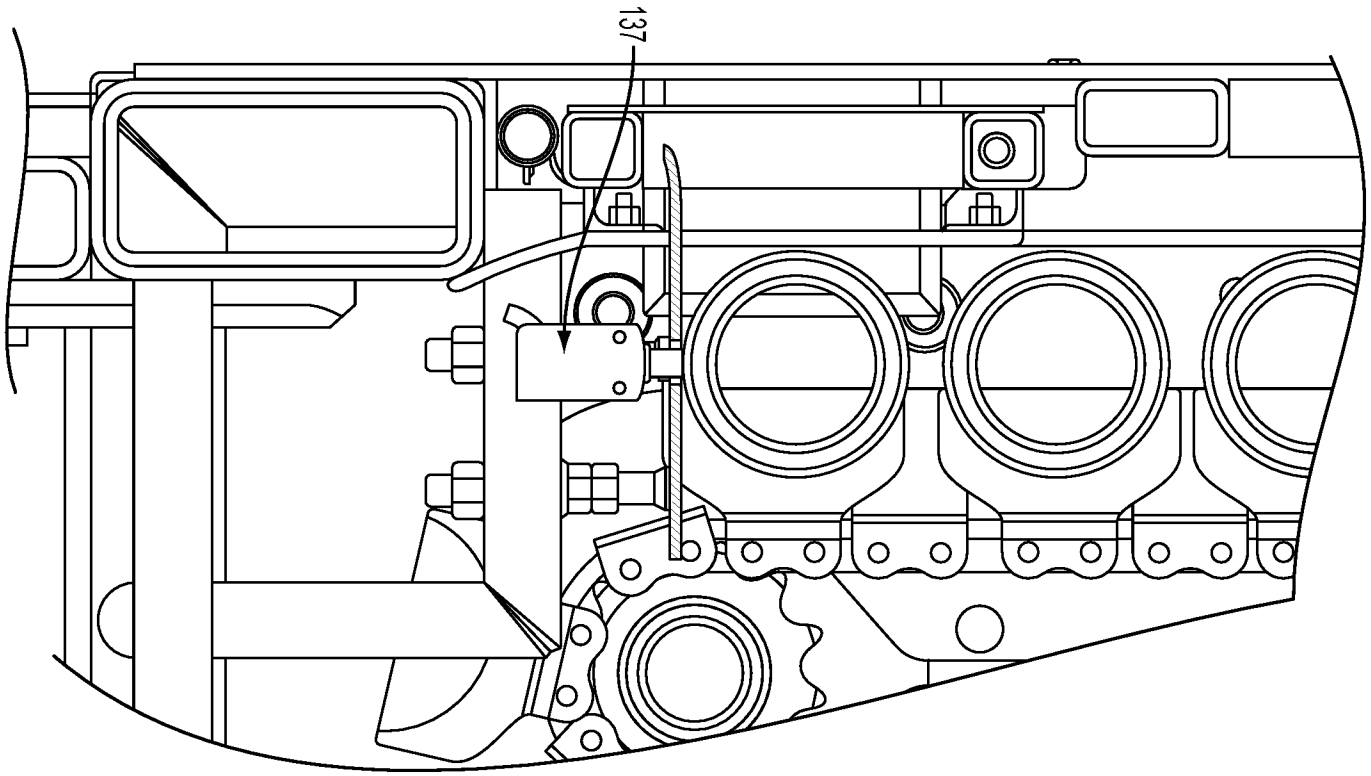
FIG. 12 illustrates an exemplary location of an optional fourth sensor configured to indicate whether the magazine can accept additional drill string components.

In additional aspects, stop systems can be incorporated so that movement of the conveyor chains and the armature assembly can be under continuous positive control to minimize the potential for operator injury and system operational failure. In operation and as illustrated in FIG. 8, a first sensor 132 can be positioned near the dispensing end and be configured to indicate when the armature assembly is inside the magazine assembly. When the first sensor indicates the armature assembly is rotationally positioned to accept a new drill string component as illustrated in FIG. 9, a sixth sensor 134 can be configured to indicate that the armature assembly can receive a new drill string component. With the first and sixth sensors active, the conveyor roller chain can be activated and index a new drill string component into the open armature assembly. As the new drill string component is advanced into the armature assembly, a fifth indexing sensor 136 can be activated and indicates that the conveyor roller chain has advanced. An optional fourth sensor 137, illustrated in FIG. 12, can be configured to indicate whether or not additional drill string components currently resides in the loading end and, thus, whether or not a new drill string component can be inserted into the magazine at the loading end. Subsequently, a third sensor 138 located on the armature assembly indicates that a drill string component can be positioned inside the armature assembly prompting the armature assembly to actuate to securely grasping the drill string component. When the armature assembly closes, the sixth sensor can be deactivated. The armature then rotates to a position outside the magazine assembly as illustrated in FIG. 11, activating a second sensor 140 configured to indicate that the drill string component can now be transferred to the drill head. The drill head can be moved into a position that can be substantially co-axial with the drill head and the drill head can be threaded into the drill string component. After the drill string component is secured to the drill head, the armature assembly can be configured to actuate to release the drill string component. The sixth sensor can be again activated to indicate that the armature assembly is empty and the armature assembly rotates back into the magazine housing, repeating the above-described operational sequence.

In certain aspects, the stop system can comprise sensors selected from the group comprising mechanical sensors, proximity sensors, linear position sensors, distance measurement sensors and angle sensors. Mechanical sensors can be, for example and without limitation, a limit switch or the like coupled with a head where the head can be a plunger, roller and the like. Proximity sensors can be, for example and without limitation, inductive sensors, capacitive sensors, ultrasonic sensors and the like. Linear position sensors can be, for example and without limitation, inductive sensors and the like. Distance measurement sensors can be, for example and without limitation, inductive sensors, ultrasonic sensors, eddy current sensors and the like. Angle sensors can be, for example and without limitation, inductive sensors and the like.

Accordingly, FIGS. 1-12, and the corresponding text, provide a number of different components and mechanisms to store, handle and position drill string components. In addition to the foregoing, implementations described herein can also be described in terms acts and steps in a method for accomplishing a particular result. For example, a method comprising at least one of storing, handling and positioning drill string components is described concurrently above with reference to the components and diagrams of FIGS. 1 through 11.

Thus, implementations of the foregoing provide various desirable features. For instance, the magazine assembly provided herein integrates the handling, storage and positioning of drill string components. In another instance, the magazine assembly provided herein can increase safety and decrease costs associated with traditional means for handling, storing and positioning drill string components relative to a drill head.

The present invention can thus be embodied in other specific forms without departing from its spirit or essential characteristics. The described aspects are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A handling apparatus for handling elongate drill string members, comprising:

a magazine assembly configured for storing and moving a plurality of drill string members, the magazine assembly comprising a first aperture at a first end, a second aperture at a spaced second end, wherein the magazine assembly defines a serpentine interior path that extends between the first and second apertures, the magazine assembly further comprising:

a pair of opposed, synchronized, and continuous conveyor roller chains, each conveyor roller chain being rotatable about a pair of spaced sprockets having a common chain elongate longitudinal axis, wherein the pair of opposed conveyor roller chains are positioned in a common plane, wherein the respective common chain elongate longitudinal axis of the pair of opposed conveyor roller chains are positioned parallel to each other such that a portion of each conveyor roller chain is positioned in spaced parallel opposition, and wherein portions of the pair of opposed conveyor roller chains define the serpentine interior path;

a plurality of seats coupled to each of the conveyor roller chains, wherein each seat is shaped and configured to substantially mirror a portion of the exterior cross-sectional shape of the drill string member, wherein each seat is configured to controllably urge one drill string member about the serpentine interior path as the pair of conveyor roller chains are actuated, and wherein the elongate drill string member remains seated in the seat as it is urged along the serpentine interior path of the magazine assembly; and an armature assembly operatively associated with the magazine assembly configured to selectively grasp one drill string member at the second end and subsequently move the drill string member into a desired position; and a translation means for selectively rotating the magazine assembly about a rotation axis.

2. The handling apparatus of claim 1, wherein the translation means for selectively rotating the magazine assembly is configured to selectively rotate about the rotation axis from a substantially horizontal position to a substantially vertical position.

3. The handling apparatus of claim 1, wherein the translation means further comprises means for selectively moving the magazine assembly along and about a longitudinal axis of the magazine assembly.

4. The handling apparatus of claim 1, wherein the serpentine interior path of the magazine assembly is S-shaped.

5. The handling apparatus of claim 4, wherein each conveyor roller chain follows a racetrack path.

6. The handling apparatus of claim 1, wherein the pair of conveyor roller chains further comprises a plurality of opposed, synchronized, and continuous conveyor roller chains.

7. The handling apparatus of claim 6, wherein the plurality of opposed, synchronized, and continuous conveyor roller chains further comprises two spaced and opposed pairs of conveyor roller chains.

8. The handling apparatus of claim 1, wherein the pair of conveyor roller chains is synchronistically driven by one drive chain.

9. The handling apparatus of claim 1, further comprising a stop system configured to provide continuous positive control of the magazine assembly.

10. The handling apparatus of claim 1, wherein, along the portion of each conveyor roller chain that is positioned in spaced parallel opposition, the respective seats on each conveyor roller chain are positioned in opposition and define a partially enclosed opening that is sized and shaped to mirror a portion of the exterior cross-sectional shape of the drill string member.

11. The handling apparatus of claim 10, wherein the magazine assembly further defines interior walls that define portions of the serpentine interior path of the magazine assembly.

12. The handling apparatus of claim 11, wherein each interior wall is spaced from a portion of a respective conveyor chain such that each seat coupled to that respective portion of each conveyor roller chain that is positioned in spaced parallel opposition is positioned is spaced opposition to the interior wall at a distance that is substantially equal to the exterior cross-sectional diameter of the drill string member.

13. The handling apparatus of claim 1, wherein the pair of conveyor roller chains is selectively operated in a load direction or an opposite unload direction.

14. The handling apparatus of claim 1, wherein the armature assembly is configured to move about and between an open position and a closed position, in which one drill string component is fixed grasped by the armature assembly.

15. The handling apparatus of claim 14, wherein the stop system comprises a plurality of sensors.

16. The handling apparatus of claim 15, wherein the plurality of sensors comprises a first sensor that is positioned near the second end and is configured to sense when the armature assembly is positioned inside the magazine assembly proximate the second aperture.

17. The handling apparatus of claim 16, wherein the plurality of sensors comprises a second sensor that is positioned near the second end and is configured to sense when the armature assembly can receive one drill string member, wherein the second sensor is positioned proximate the second aperture.

18. The handling apparatus of claim 17, wherein, when the first sensor senses that the armature assembly is positioned inside the magazine assembly proximate the second aperture and the second sensor senses that the armature assembly can receive one drill string member, the pair of conveyor roller chains can be selectively activated to index one drill string member into the armature assembly that is positioned in the open position.

19. The handling apparatus of claim 18, wherein the plurality of sensors comprises a third sensor positioned on the armature assembly that is configured to sense when the drill string member is being grasped, and wherein, when the third sensor senses that the drill string member is being grasped, the second sensor is deactivated.

20. A drilling system having a drill head, comprising:

a handling apparatus for handling elongate drill string members, comprising:

a magazine assembly configured for storing and moving a plurality of drill string members, the magazine assembly comprising a first aperture at a first end, a second aperture at a spaced second end, wherein the magazine assembly defines a serpentine interior path that extends between the first and second apertures, the magazine assembly further comprising:

a pair of opposed, synchronized, and continuous conveyor roller chains, each conveyor roller chain being rotatable about a pair of spaced sprockets having a common chain elongate longitudinal axis, wherein the pair of opposed conveyor roller chains are positioned in a common plane, wherein the respective common chain elongate longitudinal axis of the pair of opposed conveyor roller chains are positioned parallel to each other such that a portion of each conveyor roller chain is positioned in spaced parallel opposition, and wherein portions of the pair of opposed conveyor roller chains define the serpentine interior path;

a plurality of seats coupled to each of the conveyor roller chains, wherein each seat is shaped and configured to substantially mirror a portion of the exterior cross-sectional shape of the drill string member, wherein each seat is configured to controllably urge one drill string member about the serpentine interior path as the pair of conveyor roller chains are actuated, and wherein the drill string member remains seated in the seat as it is urged along the serpentine interior path of the magazine assembly; and an armature assembly operatively associated with the magazine assembly configured to selectively grasp one drill string member at the second end and subsequently move the drill string member into a desired position that is substantially coaxial to the drill head.

21. The drilling system of claim 19, wherein the handling apparatus further comprises a translation means for selectively rotating the magazine assembly about a rotation axis and for selectively moving the magazine assembly along and about a longitudinal axis of the magazine assembly.

* * * * *